United States Patent [19]

Brand et al.

[11] Patent Number: 4,829,285

[45] Date of Patent: May 9, 1989

[54] IN-HOME EMERGENCY ASSIST DEVICE

[75] Inventors: Marc I. Brand, 9421 N. Ironwood La., Des Plaines, Ill. 60016; Kenneth E. Lash, Tinley Park; Brenda A. Torres, Chicago, both of Ill.

[73] Assignee: Marc I. Brand, Arlington Heights, Ill.

[21] Appl. No.: 61,879

[22] Filed: Jun. 11, 1987

[51] Int. Cl.[4] ..... G08B 21/00

[52] U.S. Cl. ..... 340/573; 340/529; 340/539; 340/689; 379/38

[58] Field of Search ..... 340/573, 686, 689, 527, 340/501, 529, 539; 379/38

[56] References Cited

U.S. PATENT DOCUMENTS

| | | | |
|---|---|---|---|
| 2,135,476 | 11/1938 | Rugh | 340/574 |
| 3,594,748 | 7/1971 | Grotjahn | 340/573 |
| 3,614,763 | 10/1971 | Yannussi | 340/573 |
| 3,634,885 | 1/1972 | Barkley | 340/573 |
| 3,740,648 | 6/1973 | Grotjahn | 340/539 |
| 3,925,773 | 12/1975 | Green | 340/529 X |
| 4,012,732 | 3/1977 | Herrick | 340/529 X |
| 4,183,019 | 1/1980 | Lekhtman | 340/539 |
| 4,284,986 | 8/1981 | Amortegai | 340/573 |
| 4,524,243 | 6/1985 | Shapiro | 340/573 X |
| 4,622,544 | 11/1986 | Bially et al. | 340/573 X |
| 4,667,188 | 5/1987 | Schwartz | 340/689 |

*Primary Examiner*—Glen R. Swann, III

*Attorney, Agent, or Firm*—Allegretti & Witcoff, Ltd.

[57] ABSTRACT

An alarm for sending out distress information when the user is in an abnormal position or when the user wishes to alert others of a distress condition. The alarm includes an omni-directional tilt switch and a transmitter. When the tilt switch has passed a critical angle, a signal is sent to a delay circuit. The delay circuit waits for a predetermined period of time, such as ten seconds, before enabling a transmitter. The transmitter then sends information over a communication link, signaling others that the user is in need of assistance. The invention further includes an alarm for alerting the user that the predetermined position of the tilt switch has been satisfied and that, after the predetermined delay, the distress information will be transmitted over the communication link unless deactivated by the user.

8 Claims, 3 Drawing Sheets

IN-HOME EMERGENCY ASSIST DEVICE

BACKGROUND OF THE INVENTION

The present invention relates generally to alarms and more particularly to an alarm that senses when a user has encountered an emergency situation and requires assistance. Great advances in the medical field have occurred, particularly in the second-half of the twentieth century. In addition, the U.S. public has generally increased its awareness of health issues and become more concerned with proper exercise. Accordingly, the average age of the U.S. population has steadily increased. Consequently, more senior citizens tend to be living alone in their own homes than ever before. Being solitary and away from family unity, there is increased potential risk of unattended emergencies.

Often, persons involved in serious accidents in their own home are found to have waited helplessly for hours before discovery. Persons who have encountered a serious accident may simply be unable to draw attention to their predicaments.

Some individuals living alone may require assistance, because of age or sickness, to simply rise up from a collapsed state. Other individuals, who are victims of multiple sclerosis, cerebral palsy, muscular dystrophy, or simply prone to dizziness or sudden illness may similarly require assistance in rising.

Unfortunately, many presently available alarms are poorly suited to meet the needs of individuals who live alone and may require assistance in the case of an emergency. Some individuals may be unconscious while in an emergency state, unable to activate any alarm manually. Other devices may be prone to set off alarms whether or not the individual requires assistance simply because the individual has moved in an erratic fashion.

With some social alarm systems, SOS cards or flashing signs are placed in the home window to indicate an emergency situation. Window signs, however, do not guarantee a response and also undesirably advertise the vulnerability of the individual to the passing public.

Private wiring between and in adjacent to buildings was, for a time, a suitable alarm system in sheltered housing. Pushbuttons and/or pull cord switches, located near floor level, were strategically placed throughout the home and connected to the trigger circuit. This system included disadvantages however. For example, in order for it to work, the person needing help must be able to reach one of the pushbuttons or pull cords. In addition, the warden of the shelter must be available to monitor the indicators at a central station.

An alternative to private wiring in sheltered housing is a communication link through a two-way microphone-loud speaker unit. This system may be effective, for example, even if the person requiring help is on the floor some ten meters from the unit. If the houses were dispersed in a city, or if a rural area is considered, a long-range alarm transmission link is required. Such a system may similarly be triggered by pushbuttons and/or pull cords. In addition, individual users may be scanned a pre-set number of times per day and the user's failure to respond to the scan may be interpreted as an alarm or fault condition. Again, however, such a system requires constant monitoring by someone else at a central station and coherent consciousness of the user.

Another alarm system was developed which requires the user's home to be fitted with a combination unit consisting of a radio-frequency receiver and a telephone auto-dialer. Data dialer was triggered by the receiver as it sensed the transmitter signal. The activation of the signal was obtained by a pushbutton in the transmitter case. A telephone call was received by an unmanned computerized control station which may relay the calls for outside help. Such a system, however, failed to help an unconscious victim.

Present devices often require that the user press a button, pull a cord, or speak into an intercom to indicate that help is needed. Should the person become unconscious due to falling, heart attack, fainting, he/she may lie there for hours before anyone scans the user and is aware of his/her condition.

SUMMARY OF THE INVENTION

In a principal aspect, the present invention is an improved alarm for sending distress information over a communication link. The alarm includes a tilt switch, transmitter, delay circuit, reset circuit, and a "beeper." The tilt switch sends a tilt signal in response to being turned to a pre-determined position. Thus, should the user fall down and, for example, lie at a sever angle with respect to a vertical line, the switch will send a signal indicating the user's emergency. The delay means receives the tilt signal, however, counts a predetermined period of time, and enables the transmitter to send the distress information. The transmitter may then transmit distress information over the communication link. The reset means may be manually activated to stop transmission of the distress information.

The beeper alerts the user that the predetermined position of the tilt switch has been satisfied and thus, after a predetermined time delay has elapsed, the distress information will be transmitted over the communication link unless the reset means has been manually activated. In this way, the user may prevent the transmission of the distress information during the pre-determined period of time that the delay circuit is counting or may, of course, stop the termination of the distress information after the emergency has ceased.

It is an object of the present invention to provide an improved alarm for sending distress information over a communication link. It is intended with the present alarm, or in-home emergency assist device, will allow individuals presently dependent upon others to live alone. Some hospital patients may even be discharged earlier than expected because of the availability of such an alarm aid. The invention may also help elderly people preserve their independence and perhaps provide an alternative to institutionalized life. It may also help give the family and friends of such individuals increased peace of mind. More importantly, the device will more effectively send out a signal for help which is independent of the mental alertness or physical coordination of the user.

Another goal of the present invention is to more reliably transmit signal to obtain outside help when the user is in need of assistance. A further goal is an alarm having a smaller size, so as to not substantially hinder normal daily activity by the user.

These and other objects, features, and advantages of the present invention are discussed or apparent in the following detailed description.

BRIEF DESCRIPTION OF THE DRAWING

A preferred embodiment of the present invention is described herein with reference to the drawing wherein.

DETAILED DESCRIPTION OF THE PREFERRED EMBODIMENT

Referring to FIGS. 1–7, an alarm 10 sends distress information or when a user becomes unconscious when the user manually signals the need for assistance. When a person loses consciousness, gravity normally pulls the body downward. In such cases, the individual can no longer maintain his/her body parallel to a vertical axis and the angle of upper back is changed relative to that axis. Detection of this change may be used to set off a switch that can enable a transmitter.

Figure 6:
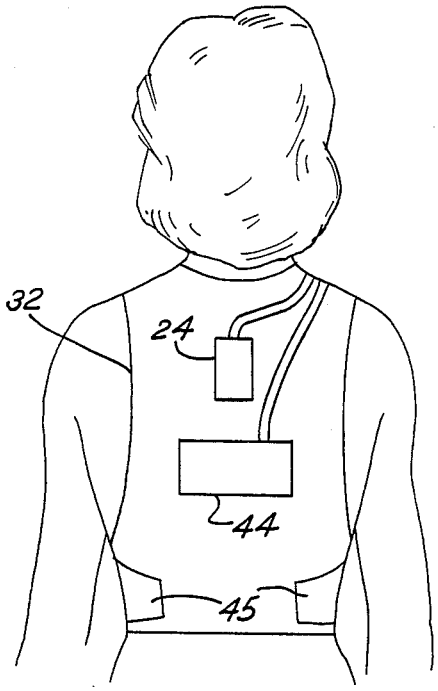
FIG. 6 is a rear view of the sensing unit of the preferred embodiment shown in FIG. 1.

Thus, an omni-directional tilt switch 24 may be placed between the user's shoulderblades (FIG. 6). This position is chosen as the location of the tilt switch, since the inventors have noted that this position is often likely to be substantially parallel to a vertical axis.

Figure 1:
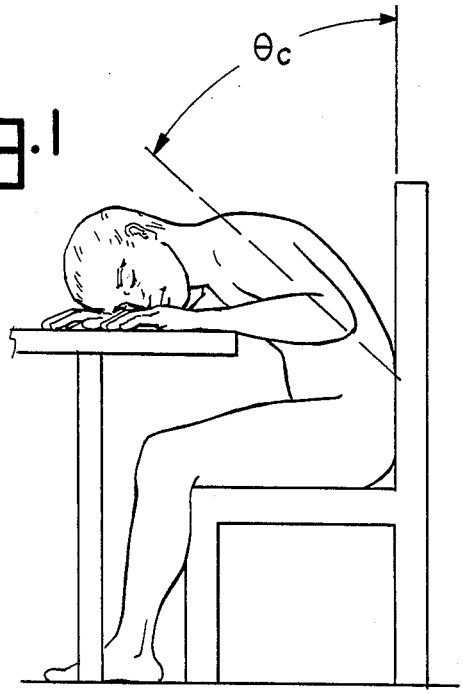
FIG. 1 is a side view of a preferred embodiment of the present invention showing how the invention may be activated to send a distress call when the user is seated.
Figure 2:
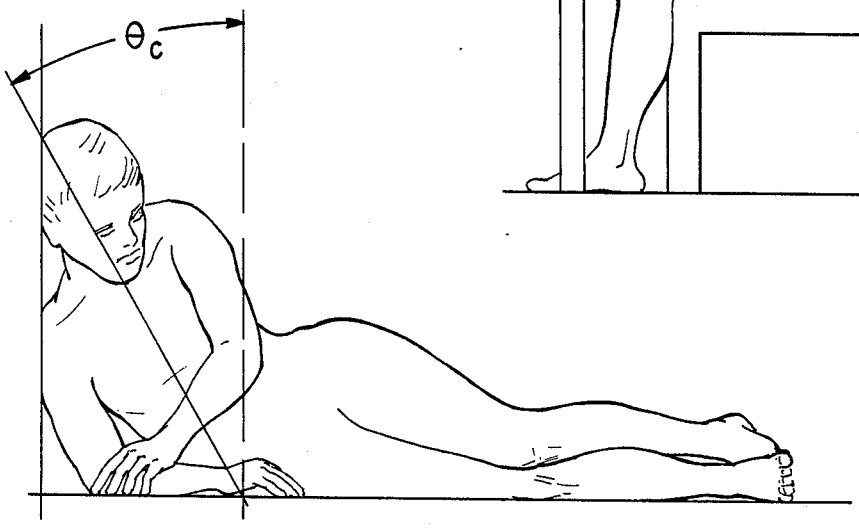
FIG. 2 is a side view of the preferred embodiment shown in FIG. 1 showing how the invention may be activated to send a distress call when the user is in a prone position.

FIG. 1 illustrates the position of the vertical axis of the user's body after he has collapsed while sitting down. FIG. 2 illustrates the position with which the inventors have found to be common after falling or collapsing.

In designing the present invention, the inventor needed to determine the approximated critical angle, $\theta_c$, that would cause a tilt switch to activate the transmitter. This angle must be sensitive enough to detect the vast majority of collapsed positions, without being overly sensitive so that it would activate the transmitter during normal daily activities of the user.

Through sampling and experimentation, the inventors have noted that the critical angle was best measured by determining the difference between the axis of the user's back and a vertical line. The most preferred critical angle for activation of the present alarm was determined to be approximately thirty-seven degrees from vertical. Nonetheless, the inventors have also noted that a critical angle of approximately between 32 and 42 degrees is also acceptable for use in the present invention. The angle could also be set in accordance with the normal position of the user throughout the day.

The alarm 10 has been designed to help minimize false alarm transmission. An indicator on the alarm 10, such as a beeper circuit 11, alerts the user that the critical angle has been exceeded. This warning will remind the user to deactivate the device during normal bending. A delay circuit is included in the design to allow the user ten seconds after the critical angle has been exceeded to prevent the transmission of false alarms. This time delay, of course, can be easily varied.

Figure 3:
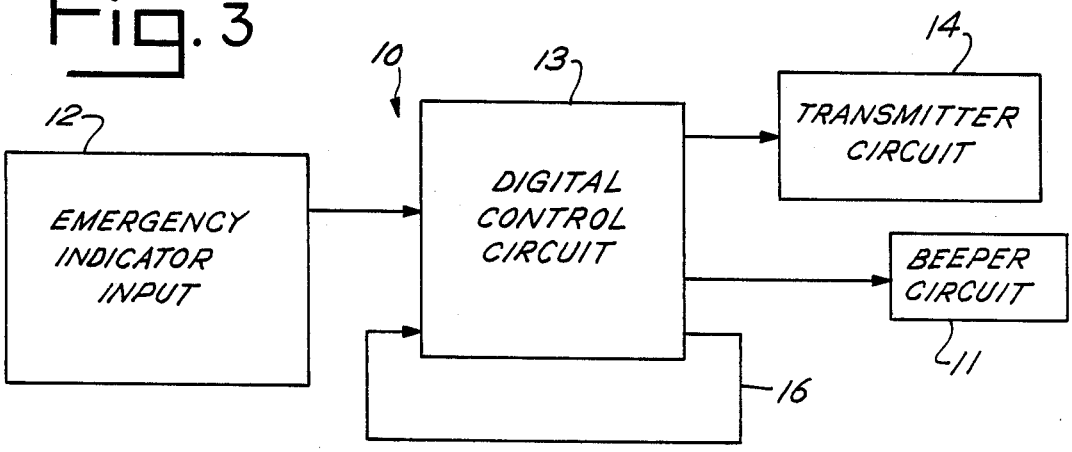
FIG. 3 is a simplified block diagram of the preferred embodiment shown in FIG. 1.

In referring to FIG. 3, the alarm 10 generally consists of an emergency indicator input 12, interfaced with digital control circuit 13 which controls the operation of transmitter circuit 14, a user feedback circuit 16, and the beeper circuit 11. The transmitter circuit 14 receives the signal from the digital control circuit 13 and thus may send out the alarm that the user requires assistance.

The feedback circuit 16 allows the user to know the state of the device, in order to manually terminate the transmission of distress information. The beeper 11 may include, for example, of an alarm, message recorder, or any other suitable means for alerting the user that either the transmitter circuit 14 will transmit a distress signal after a predetermined delay time or that the user has failed to re-enable the transmitter circuit 14.

Figure 4:
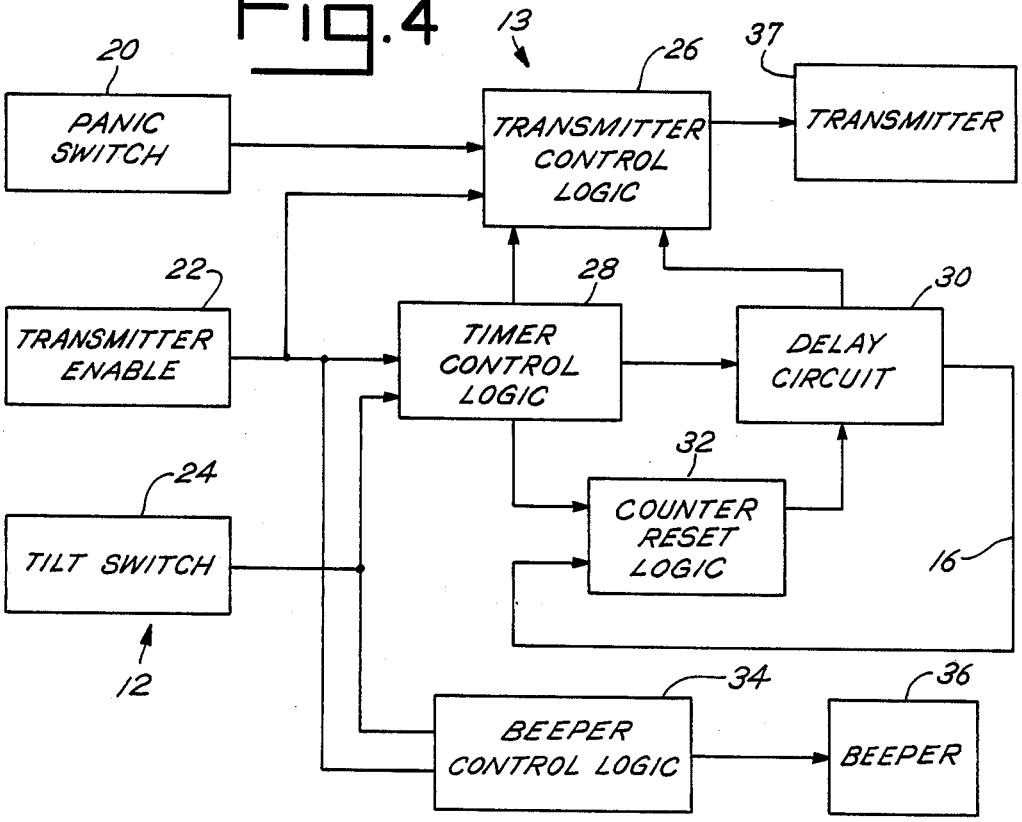
FIG. 4 is a detailed block diagram of the preferred embodiments shown in FIG. 1.

Referring to FIG. 4, the emergency indicator inputs include a panic switch 20, transmitter enable switch 22, and tilt switch 24. The digital control circuit 13 includes transmitter control logic 26, timer control logic 28, and delay circuit 30 as shown in FIG. 4.

The transmitter control logic 26 controls when and if the transmitter circuit 14 will transmit a signal over a communication link. The link may be a telephone line communication link, a radio frequency communications link, a directly wired communications link, or another suitable means for transmission of distress messages. The beeper circuit 11 includes both the beeper control logic 34, which receives input from the transmitter enable and tilt switches 22, 24, as well as an actual, noise-producing beeper 36. The counter reset logic 32 allows the delay circuit 30 to be reset for further operation after the delay circuit.

Figure 7:
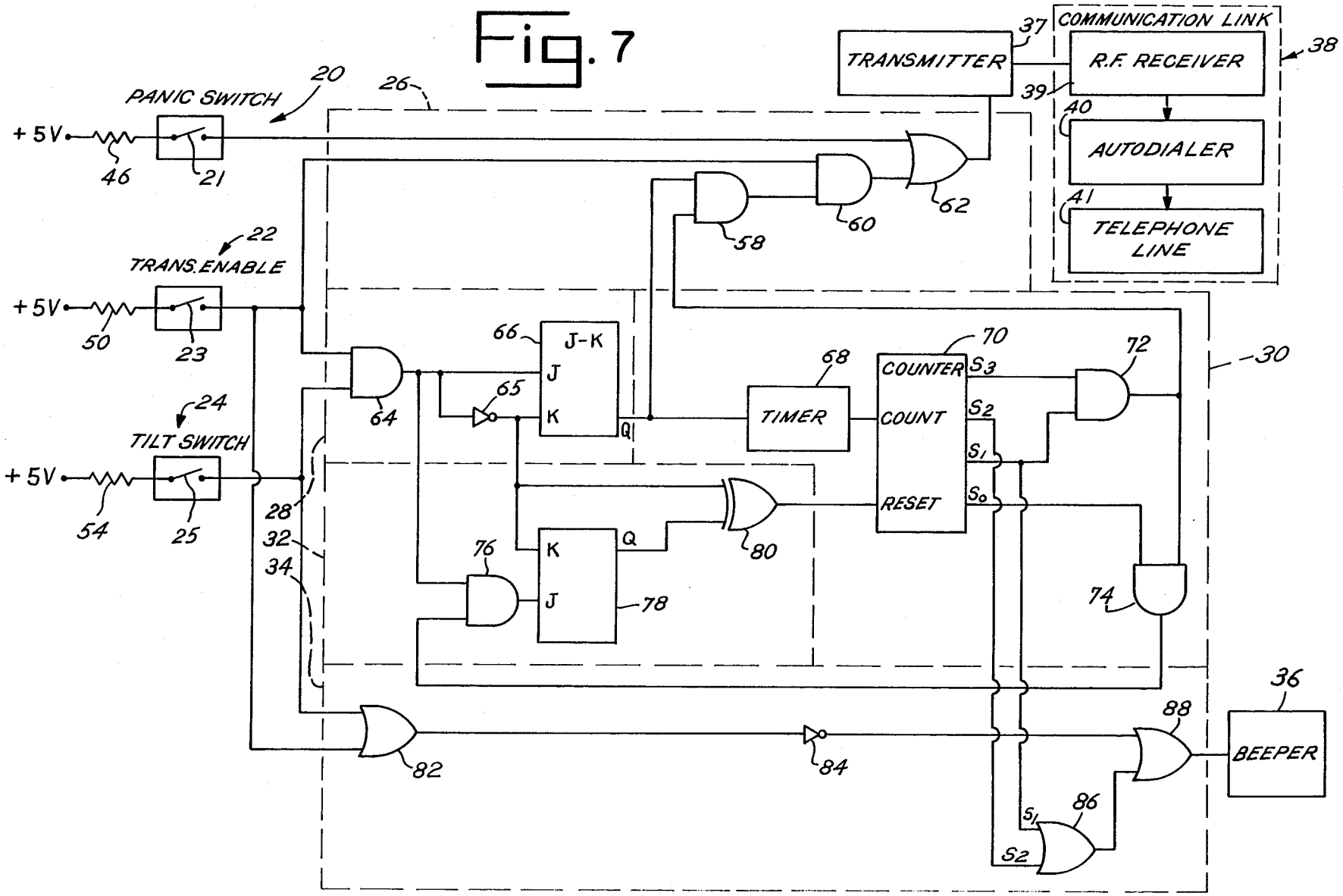
FIG. 7 is a schematic diagram of the preferred embodiment shown in FIG. 1.

The transmitter circuit 14 includes a transmitter 37, and a communication link 38 (FIG. 7). The preferred communication link 38 includes a radio-frequency receiver 39, an auto-dialer 40, and a telephone line 41. The auto-dialer thus interfaces between the transmitter 37 and the telephone line 41.

Figure 5:
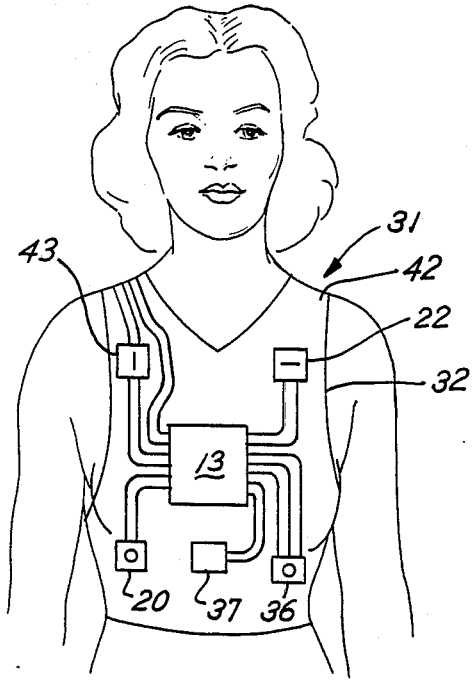
FIG. 5 is a front view of the sensing unit of the preferred embodiment shown in FIG. 1.

FIGS. 5 and 7 show the sensing unit 31 of the alarm 10 as typically worn by a user. The sensing unit 31, a light vest 42 with eight compartments, including six front compartments carrying an on/off switch 43, panic switch 20, transmitter enable switch 22, digital control logic 13, transmitter 37, and the beeper 36. The back compartments include a compartment for the tilt switch 24, located at the top and center of the user's back, and a compartment for a five-volt battery 44. The vest 42 and compartments are secured by velcro tabs 45. The abbreviated design of the harness, as shown in FIGS. 5 and 6, ensures that the vest 42 is normally not difficult to put on or fasten closed and allows freedom of arm movement so that the sensing unit 31 may be worn throughout the day in comfort.

The vest 42 is constructed so that when putting the device on, the user's head will be placed through the neck opening first and then the vest 42 will be fastened closed by the two velcro tabs 45 on the sides of the vest 42. The outer layers are made of a cool, comfortable knit. Should the vest 42 be placed on inside out, it will still function normally, since the tilt switch 24 will still be vertical. The vest 42 cannot easily be placed on upside down, because of the continuous material which is designed to cover the shoulders. The vest 42 typically will not allow insertion of the torso through the neck opening.

Each compartment of the vest should be lined with a thin foam pad. This padding protects the user from being poked by any of the components. The padding also protects the components from damage should the user fall to the ground.

As shown in FIG. 7, the panic switch 20 includes a lead interconnected to the five-volt battery and a current limiting resistor 46 interconnected to a simple on/-off switch 21. The transmitter enable switch 22 similarly includes a lead interconnected with the five-volt battery, a current-limiting resistor 50, and an on/off switch 23. In like fashion, the tilt switch 24 includes a lead interconnected to the five-volt battery, a current-limiting resistor 54, and an omni-directional tilt switch 25.

The omni-directional tilt switch 25 detects a change of angle of the body's principle versicle axis relative to the normal axis. Should the person fall while working or lose consciousness while sitting or standing, the angle of the body's principle axis will usually deviate from the normal vertical axis. This deviation will then close the omni-directional tilt switch 25. The alarm 10 will then begin testing for an emergency condition before transmitting the alarm. If the deviation from the normal vertical axis is continued for more than ten seconds and the user has not manually reset (disabled) the alarm 10, or returned to the normal, upright, substantially vertical position, a distress signal will be sent.

As previously stated, the omni-directional tilt switch 25 is required to close when the angle of approximately thirty-seven degrees is exceeded (no matter which direction the body's principle axis deviates thirty-seven degrees or so from a vertical axis). The tilt switch is commercially available. It is sensitive to omni-directional deviations from vertical at the specific critical angle.

The timer control logic 28 includes an AND gate 64, an invertor 65, and a J-K flip-flop 66. As known by those of ordinary skill in the art, two NAND gates, for example, may be used in combination to create such a J-K flip-flop. The AND gate receives inputs from the tilt switch 24 and the transmitter enable switch 22.

The transmitter control logic 26 includes two AND gates 58, 60 and an OR gate 62. Inputs to the transmitter control logic 26 are received from the panic switch 20, transmitter enable switch 22, timer control circuit 28, and the delay circuit 30.

The function of the transmitter circuit 14 is to relay an alarm state, as determined by the digital circuitry, to remote receiving unit. Once the transmitted signal has reached the receiver 39, the receiver 39 will trigger the telephone auto-dialer 40 and initiate an emergency call for help over the telephone lines 41 (telephone link).

The signal to be transmitted by the transmitter (and received by the receiver) is a radio signal. Such a signal is harmless to the user. It will pass through the walls of most houses. The transmitter 37 consists, for example, of a radio frequency transmitter with a fifty-foot range. The receiver 39, auto-dialer 40, and telephone line 41 are commonly available and are known to those of ordinary skill.

The delay circuit 30 includes a timer 68, counter 70, and AND gate 72. Inputs are received from the input-/output of the timer control logic 28 and from the output of the delay reset logic 32. The delay reset logic 32 includes two AND gates 74, 76, J-K flip-flop 78, and an exclusive OR gate 80.

The beeper control logic 34 includes three OR gates 82, 86, 88 and an inverter 84.

A function of the digital control circuit 13 is to minimize false alarm transmissions and to allow the user to carry out normal daily functions with as little hinderance as possible. Specifically, the circuitry monitors the three inputs from the panic switch, transmission enable switch, and tilt switch. Thus, from monitoring the switches, the circuitry determines the output to the two output components, the transmitter circuit 14, and beeper 36.

The three inputs, panic switch 20, transmitter enable switch 22, and tilt switch 24, are set forth in the table below. The components controlled, the transmitter 37, and beeper 36 are similarly set forth below. A truth table showing the relationship of each of the input states from the panic switch, transmitter enable switch, and tilt switch to the output states (of the transmitter and alarm) are as follows:

| Line | Panic Switch 20 | Tilt Switch 22 | Enable Switch 24 | State of Beeper 36 | State of Transmitter 14 |
|---|---|---|---|---|---|
| A | 0 | 0 | 0 | 1 | 0 |
| B | 0 | 0 | 1 | 0 | 0 |
| C | 0 | 1 | 0 | 0 | 0 |
| D | 0 | 1 | 1 | 1 | 1 |
| E | 1 | 0 | 0 | 1 | 1 |
| F | 1 | 0 | 1 | 0 | 1 |
| G | 1 | 1 | 0 | 0 | 1 |
| H | 1 | 1 | 1 | 1 | 1 |

1 = switch closed
0 = switch open
1 = component functional
0 = component not functional Lines E through H of the truth table indicate all the possible situations in which the user may have depressed the panic switch 20. Depressing the panic switch 20 sends a high signal to one input of OR gate 62, causing that gate's output to go a high state signal, thus sending a high signal to the transmitter 37. The transmitter then sends a radio-frequency signal to the receiver 39. The receiver 39 activates auto-dialer 40 which dials the emergency number summoning help via the telephone line 41.

The inputs of line D of the truth table represent two possible situations: (1) the user has fallen and is unable to secure help; or (2) the user has voluntarily exceeded the critical angle without disabling the transmitter 37.

Assuming the first situation has occurred, two high signals, one from the transmitter enable 22 and one from the tilt switch 24, are transmitted to AND gate 64 of the timer control logic 28, causing the output of the gate 64 to go high. Gate 64's output is sent to the "J" and "K" inputs of the J-K flip-flop 66. However, an inverter 65 is coupled to the "K" input to the flip-flop, causing this input to go low. Thus, the output of the J-K flip-flop 66 goes high, triggering the timer 68 to begin to transmit a square wave with one second periods.

Assuming a predetermined time delay of ten seconds is chosen, when the counter reaches a count of ten seconds, the counter outputs $S_1$ and $S_3$ will go high. These outputs are coupled with AND gate 72 to the transmitter control logic 26 which activates the transmitter 37.

AND gate 58 receives input from AND gate 72 and the output of J-K flip-flop 66, both of which are high in this situation. Thus, the output of AND gate 58 is high.

This AND gate 58 thus tests if the user is still fallen and ten seconds has elapsed, AND gate 60 receives input from AND gate 58 and transmitter enable switch 23. Again, both inputs are high and the output of AND gate 60 is high. This AND gate 60 thus tests if the alarm is enable, if the user is still fallen, and if ten seconds has elapsed. The input of OR gate 62 is the output of AND gate 60, which is high. Thus, the output of OR gate 62 is high, activating the transmitter 37.

It is important to note that the counter reset logic 34 must reset the counter 70 in the event that the device is unable to reach assistance on the first try. This function is triggered when the counter reaches eleven seconds, causing $S_0$, $S_1$, and $S_3$ outputs of the counter to go high. When this happens, the inputs to AND gates 72, 74, ad 76 go high, causing a high signal to be sent to the "J" input of the second J-K flip-flop 78. Coupling the "Q" output (high) from the J-K flip-flop 78 and the output from the inverter 65 (low) with an exclusive OR gate 80 produces a high at the output of the exclusive OR gate 80. Coupling this output to the reset input of the counter 70 resets the counter back to zero.

Assuming that the inputs of line D of the truth table represents the situation where the user has voluntarily exceeded the critical angle without disabling the transmitter, the beeper 36 will sound (whether or not user has voluntarily or involuntarily exceeded the critical angle) alerting the user to disable the transmitter 37 before the predetermined delay has expired. The beeper 36 is activated by either output $S_1$ or $S_2$ from the counter 70. If the user resumes a normal, substantially upright position during the ten-second delay period, an input to the AND gate 60 goes low and no distress information is transmitted.

After the user disables the transmitter 37, the counter reset logic must reset the counter. This occurs when the output of the transmitter enable/disable 22 or if the tilt switch 24 goes low, causing the output from gate 64 to be low. Gate 64's low output is then coupled with the inverter 65 to the exclusive OR 80. Since the other input to the exclusive OR is low, the output (output Q from J-K flip-flop) goes high, resetting the counter. The Q output of the J-K flip-flop 78, as well as the output of the AND gate 72, also go to a low state. Consequently, unless the panic switch 20 is energized, the outputs of the gates 60 and 62 go low.

Line C from the truth table represents the situation where the user voluntarily disables the transmitter for any activity for which the critical angle may be exceeded, as in reclining or taking a nap. This is achieved by the user switching the transmitter enable switch 22 from the closed to the open position. One of the inputs to the AND gate 64 is low, preventing the beeper from sounding. The transmitter enable switch 22 output is low, and output of the tilt switch 24 is high, making the output of OR gate 82 high an ensuring that the output of the inverter 84 is low. Since the output of the counter 70 is also low, the output of OR gates 86 and 88 are low, and the beeper does not sound.

Line B from the truth table represents the situation where the user is upright and the transmitter enable switch 22 remains closed, thus sending a low, disabling signal to the transmitter 37, due to the low output of AND gate 64. The output of OR gate 82 is high due to the high output of the transmitter enable switch 22 and the beeper is silent as above in Line C explanation.

Line A of the truth table represents the situation where the user has neglected to re-enable the transmitter 37 after, for example, returning from a leisurely recline. In this situation, the beeper 36 will sound continuously until the user re-enables the transmitter, reminding the user to re-enable the transmitter 37 which will silence the alarm.

The beeper control logic 34 carries out this function. Since both inputs from the transmitter enable 22 and tilt switch 24 go low, the output from gate 82 goes low. This output is coupled with an invertor 84 or OR gate 88 causing the beeper 36 to sound.

The present invention transmits a call for help in emergency situations. When the user cannot keep his/her upper body in a normal vertical position, the automatic alarm is activated. Also, the manual transmission can be activated in the case of unforeseen emergencies not detected by the automatic control such as burglary or fire. The alarm 10 is designed to normally not transmit an alarm signal when the upper body is at an angle other than the body's normal vertical axis during one's daily activities. Thus, for example, bending, reclining in a chair, or leisurely rest should not transmit an alarm under most circumstances.

Should the alarm transmit or be disabled allowing for prone relaxation, the alarm 10 informs the user that distress information was sent or reminds the user to re-enable the transmitter after he/she returns to a normal vertical position. Moreover, the alarm 10 is designed to be comfortable, compact, and lightweight so that the sensing unit may be worn all day.

In addition to being able to vary the angle which determines an emergency, the alarm 10 will accommodate each individual user. When the alarm 10 is used at home, the transmitter 37 should have a large enough range to reach all ends of the home. Of course, the alarm 10 may be modified so that it may be adapted for use in an office building or other location where the user will spending substantial amounts of time and for which a telephone auto-dialer and receiver may be used.

A preferred embodiment of the present invention is described herein. It is to be understood, of course, that changes and modifications may be made in the embodiments without departing from the time scope and spirit of the present invention, as defined by the appended claims.

What is claimed is:

1. An alarm for sending distress information over a communication link comprising, in combination:

A multi-directional tilt switch for emitting a tilt signal in response to being turned to a predetermined position, whereby said predetermined position is indicative of a user's emergency;

delay means for receiving said tilt signal, waiting a predetermined period of time, and thereafter sending an enable signal;

transmission means for receiving said enable signal and responsively transmitting said distress information over said communication link;

clear means for stopping transmission of said distress information;

distress information alarm means for receiving said tilt signal and alerting the user that the predetermined position is satisfied, whereby said user is informed that unless said clear means is activated, said distress information will be transmitted over said communication link after said predetermined period of time has elapsed;

activation means for selectively enabling and disabling said alarm, whereby said user may voluntarily disable said alarm and then said multi-directional tilt switch may turn to said predetermined position without triggering transmission of said distress information over said communication link; and second alarm means for reminding said user to re-enable said alarm after said multi-directional tilt switch first turns to said predetermined position and then turns to another position.

2. The alarm of claim 1 further comprising panic switch means for being manually activated and triggering transmission of said information over the communication link.

3. The alarm of claim 1 wherein the communication link comprises:

a transmitter for receiving a digital pulse from said delay means and responsively transmitting a radio-frequency signal; and a telephone auto-dialer for receiving the radio-frequency signal from said transmitter and thereupon triggering transmission of said distress information to an assist station over a telephone line.

4. The alarm of claim 1 wherein the delay means includes a timer coupled with a counter, whereby a digital pulse transmitted to said transmitter after a predetermined delay.

5. The alarm of claim 4 further including counter reset means for resetting the counter after the predetermined delay has expired.

6. An alarm for sending distress information over a communication link comprising, in combination:

A multi-directional tilt switch for emitting a tilt signal in response to being turned to a predetermined position, whereby said predetermined position is indicative of a user's emergency;

delay means for receiving said tilt signal waiting a predetermined period of time, and thereafter sending an enable signal;

switch enable means for being manually activated and issuing a change signal to change an enable state of said transmitter;

transmission means responsive to said enable signal from said delay circuit, for transmitting a radio-frequency signal;

receiver means for accepting said radio frequency signal and responsively using distress information over a telephone line;

clear means for being manually activated by said user and responsively stopping said delay means from issuing an enable signal;

a beeper for issuing a sound wave signal;

beeper activation means for receiving said tilt signal and responsively activating said beeper to alert said user that said predetermined position was satisfied and that, after said predetermined time, said distress information will be issued; and second beeper activation means for receiving said tilt signal and change signal and responsively activating said beeper to alert the user that said transmitter is disabled and said tilt switch is in said predetermined position, whereby said beeper reminds the user to re-enable the transmitter.

7. The alarm of claim 6 further comprising a panic switch for being manually activated and triggering transmission of said radio-frequency signal.

8. The alarm of claim 6 wherein said receiver means includes a telephone auto-dialer for receiving the radio-frequency signal and responsively dialing a telephone number; and a telephone transmitter for sending distress information over a telephone line.

* * * * *